United States Patent [19]

Kuosa et al.

[11] Patent Number: 4,633,774

[45] Date of Patent: Jan. 6, 1987

[54] CONTROL DEVICE FOR A ROLL PRESS

[75] Inventors: Harri Kuosa; Tapani Kultaranta, both of Järvenpää , Finland

[73] Assignee: Oy Wärtsilä AB, Helsinki, Finland

[21] Appl. No.: 731,793

[22] Filed: May 8, 1985

[30] Foreign Application Priority Data

May 18, 1984 [FI] Finland ..... 842013

[51] Int. Cl.[4] ..... B30B 15/26; B30B 15/16

[52] U.S. Cl. ..... 100/43; 100/47; 100/162 B; 100/170; 29/116 AD; 72/8; 72/20; 72/243

[58] Field of Search ..... 100/43, 47, 168, 170, 100/162 B; 29/116 AD, 113 AD; 72/8, 20, 243, 245

[56] References Cited

U.S. PATENT DOCUMENTS 4,472,958 9/1984 Biondetti ..... 72/243

4,480,537 11/1984 Agronin et al. ..... 100/47 X 4,481,799 11/1984 Glattfelder ..... 100/162 B

*Primary Examiner*—Peter Feldman

*Attorney, Agent, or Firm*—Birch, Stewart, Kolasch & Birch

[57] ABSTRACT

A control device in particular in a multi-roll press (22 to 24) of a calender intended for the glazing of a continuous thin web, such as a paper web, which said press comprises a compensated upper roll (22), a compensated lower roll (24), and at least one press roll (23) fitted between the rolls. The control device itself comprises a press-load control circuit (B, C, D, 11, 14, 15; A, 29, 30), a compensation circuit (E, 16, 17) for the upper roll (22), as well as a compensation circuit (F, 27, 28) for the lower roll (24). According to the invention, both of the compensated circuits (E, 16, 17 and F, 27, 28) are, via their own feedbacks (12 and 13), connected to the control circuit (B), which is fitted so as to select the most slowly changing one from among the signals of the feedbacks (12 and 13) and to brake down the roll (22 or 24) whose compensation is being varied most rapidly. By means of the invention, the calender will always be loaded in a constant way, whereby a better paper quality and constant running values are obtained.

1 Claim, 1 Drawing Figure

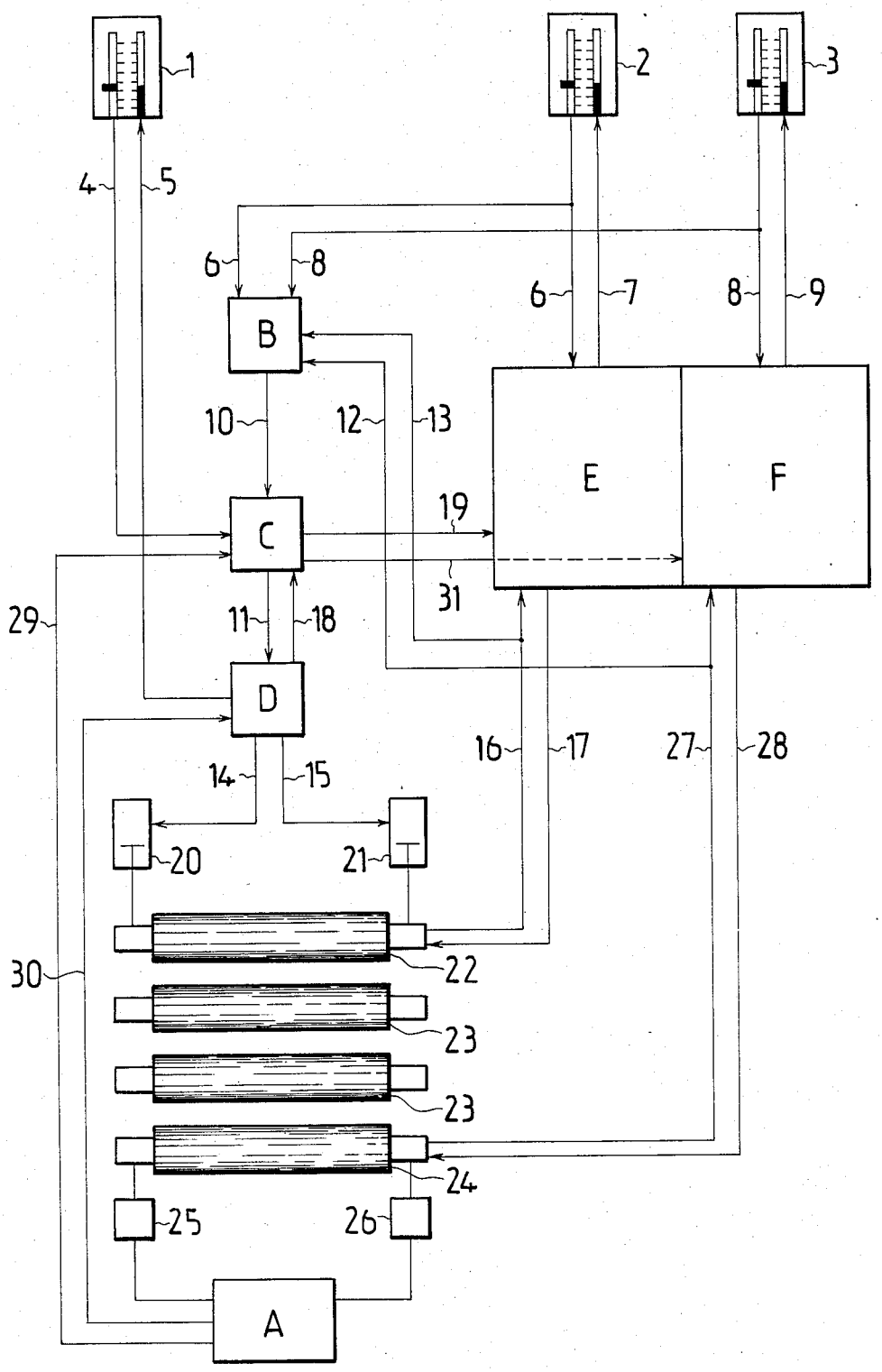
1
2
3
4
5
6
8
6
7
8
9
B
10
12
13
E
F
19
C
31
29
11
18
D
16
17
27
28
14
15
20
21
30
22
23
23
24
25
26
A

CONTROL DEVICE FOR A ROLL PRESS

BACKGROUND OF THE INVENTION

Field of the Invention

The present invention concerns a control device for bending compensation control of a multi-roll press.

Description of Background Art

Such a control device is suitable for use in particular in a multi-roll press of a calender intended for the glazing of a continuous thin web, such as a paper web. In a press constructed for this purpose, there are mostly several different rolls placed one above the other in the vertical plane. The topmost one of the rolls and the lowermost one are bending-compensated rolls. In order to increase the line pressure generated by means of the force of gravity of the rolls power units are used at the ends of the topmost roll. Most commonly hydraulic cylinders are used by means of which the press load is controlled. The hydraulic control circuits for varying the bending of the topmost and of the lowermost roll and for adjusting the loading are separate.

In a roll press, the continuous web is glazed so that the web is threaded from the top downwards through the nips between the rolls. The line pressure in the nips increases when going downwards, owing to the weight of the rolls. In order to increase the line pressure in excess of the pressure generated by the force of gravity, power units are placed at the ends of the topmost roll, most commonly hydraulic cylinders, so as to produce and adjust the load.

As the rolls are supported at both ends of their shafts, the extreme rolls in the stack of rolls are bent owing to the load. In order to keep the outer face of the rolls straight and the line pressure uniform, bending-compensated rolls are used as the extreme rolls. Of these compensated rolls, there are several designs of different constructions. However, one common feature of these rolls correction of the deflection dependent on the line pressure, which correcting takes place by adjusting the pressure in the hydraulic system provided between the stationary shaft and the revolving mantle of the roll. This pressure acts upon the mantle either directly or, by means of mobile members, indirectly and keeps the mantle straight and transfers the load to the shaft, which, being resilient, is bent. As a rule, the deflection of the mantle and of the shaft cannot be measured during the operation of the roll press, but for each compensated roll there are predetermined specific adjustment values dependent on the line pressure.

When a multi-roll press is being started and stopped as well as in connection with a paper break, the rolls are either connected with each other or detached from each other by means of a vertical movement of the lowermost roll. The objective of such detaching is to protect the soft-face rolls in the stack of rolls from damage in the case of a break in the web. During the operation of a roll press, a situation often occurs in which the load connected to the topmost roll is changed. In connection with these variations, in particular the mantle of the uppermost compensated roll is deflected, because the hydraulic compensation circuit and the hydraulic load-adjustment circuit operate at different speeds. In the present-day solutions, the operations of the circuits are interconnected so that, when the load is changed, the information on the change passes to the compensation circuit in order to produce a corresponding change. The operation of the compensation circuit is, however, slower than that of the load-adjustment circuit of simpler construction, and in this way unfavourable differences in pressure of short duration arise in the line load in the nip, and so also, in particular in the soft rolls, depressions and changes in the diameter, because of which rolls must be replaced for repair operations.

Most commonly, the hydraulic cylinders that produce the press load are connected together, and the same hydraulic pressure is effective therein. The efficiency of the controlling of the load can be improved further by connecting a separate control circuit to both of the cylinders that generate the press force and by using weight measurement elements in accordance with the Finnish Patent Application No. 810466 at the ends of both the uppermost and the lowermost roll and by providing the adjustment of the line pressures in the uppermost and lowermost nips by means of a processing circuit so that it corresponds to the result of glazing of the paper.

According to the Finnish Patent Application No. 833307, between the press-load control circuit and the compensation circuit of the compensated rolls, a feedback loop is provided, which is arranged so that, in connection with a change in the set value of the press load, it retards the change in the press load so that this change takes place in an appropriate ratio to the speed of control of the compensated rolls.

SUMMARY AND OBJECTS OF THE INVENTION

The objective of the present invention is a further improvement of the control device in accordance with the FI Patent Application No. 833307.

The invention is based thereon that the control system is divided into three parts, namely (1) a compensation circuit for the upper roll, which receives its instructions from the hydraulic pressure of the press load, (2) a compensation circuit for the lower roll, which receives its instructions from load detectors which weigh the stack of rolls, and a (3) load-press control circuit, which likewise receives its statements (commands) from load detectors.

These three control circuits are connected so as to make a combined feedback control circuit, whereby their operation becomes synchronized, i.e. the control speed of the entire control circuit complies with the speed of the slowest part in the circuit.

More specifically, the control device in accordance with the invention is characterized in a device for bending-compensation control having a press-load control circuit with five feedbacks for controlling the upper and lower rolls.

The system includes load detectors, which measure the line pressure in the lowermost nip, as well as an electric measurement and control system. By means of the system, a desired line pressure in the lowermost nip can always be maintained irrespective of the diameters and the differences in friction of the paper rolls. From the control desk, the line pressure is preset directly, and not the hydraulic pressure. Thereby, reading errors are also reduced.

The system is connected together with the electric control of the compensated rolls, whereby the following advantages are obtained:

Factual running values are controlled.

The pressure on the lowermost roll is controlled in accordance with the factual line pressure (the roll has a more correct shape in each loading state).

The calender is always loaded in the same way, whereby a better paper quality as well as constant running values are obtained.

The electric control system operates more precisely and reacts to changes more rapidly.

External disturbances have a lower effect than in a pneumatic-hydraulic system.

At the upper roll, the correct shape of the crown is controlled in accordance with the pressure of the additional load.

BRIEF DESCRIPTION OF THE DRAWING

The control device in accordance with the invention will be examined in the following in more detail with the aid of the accompanying drawing. The drawing shows one control device in accordance with the invention as a block diagram.

DETAILED DESCRIPTION OF THE PREFERRED EMBODIMENT

The control circuit for the press load consists of hydraulic cylinders 20 and 21, of hydraulics control electronics D and control apparatus 1 for same, of load detectors 25 and 26, as well as of measurement electronics A for same.

The compensation circuit for the upper roll 22 consists of compensation control electronics E, of control apparatus 2, as well as of a control signal circuit 18, 19.

The compensation circuit for the lower roll 24 again consists of compensation control electronics F, of control apparatus 3, as well as of a control signal circuit 29, 31.

Besides the displays for the factual values and for the set values, the control apparatuses 1, 2 and 3 also include fine adjustment (±0.5 bar) for the bending compensation.

The following description of operation relates to a situation in which the rolls are placed together and there is some additional load (press load). The additional load is changed, i.e., a stepwise change is carried out in the set value by means of the control apparatus 1. A corresponding signal passes via the line 4 into the circuit C and from there further into the circuit D. Before arriving in the circuit D, the signal passes via the line 19 into the circuit E and via the line 31 into the circuit F and induces start of compensation in the compensation circuits for the upper roll and for the lower roll (upper and lower circuits).

The information on the start of compensation is recorded in the circuit B (the information passes via the lines 12 and 13).

From among the signals coming via the lines 12 and 13, the circuit B selects the signal that is changing most slowly, via C starts braking the roll that is being compensated faster, and at the same rate, further via C, transmits the change in the statement for additional load to the hydraulic circuit D. The objective of the process is to synchronize all of the three control circuits so that they operate at the rate of the slowest circuit.

When the set value for additional load reaches D and the circuit starts being controlled, the factualvalue signal is received from the load detectors 25 and 26 via the circuit A and via the line 30 to the control means D.

When the upper circuit E is being controlled, the set value passes along the route 18 and 19 through the circuit C into the circuit E. The circuit C takes the signal (10) coming from the circuit B into account and, on its basis, when necessary, brakes down the rate of change in the set value of the circuit E. By means of the output 17 of the circuit E, the compensation is increased or reduced, and the circuit E receives the factual-value message required by it.

When the lower circuit F is being controlled, the set value passes along the route 29 and 31 through the circuit C into the circuit F. The circuit C again takes the signal (10) coming from the circuit B into account and, on its basis, when necessary, brakes down the rate of change in the set value of the circuit F. By means of the output 28 of the circuit F, the compensation is increased or reduced, and the circuit F receives the factual-value message required by it via the line 27.

The function of the lines 6 and 8 is, by means of the circuit B, to take care that, if a fine adjustment is performed on the upper or lower circuit, this adjustment does not affect the control of the additional load.

The circuits A, B, C, D, E, and F are programmable in a way known per se, so that, e.g., all sorts of combinations of rolls are taken into account automatically.

What is claimed is:

1. A device for bending-compensation control of a multi-roll press of a calender for glazing of a continuous thin web, such as a paper web, which press comprises an upper roll (22) with a first compensation circuit (E), a lower roll (24) with a second compensation circuit (F), and at least one press roll (23) arranged between the upper and the lower roll, said device comprising:

a press-load control circuit (A, B, C, D) comprising a first part (A) acting upon the lower roll (24) and a second part (D) acting upon the upper roll (22), a first feedback (13) for transfering from the first compensating circuit (E) to the control circuit (A, B, C, D) a first signal indicating the rate of compensation of the first compensation circuit (E), a second feedback (12) for transfering from the second compensating circuit (F) to the control circuit (A, B, C, D) a second signal indicating the rate of compensation of the second compensation circuit (F), means (B) in the control circuit (A, B, C, D) for selecting, among the first and second signals, the signal that indicates the slower rate of compensation and to brake down the roll (22 or 24) that has the higher rate of compensation, a third feedback (29, 31) connecting the first part (A) of the control circuit (A, B, C, D) to the first compensation circuit (E), a fourth feedback (30) connecting the first part (A) of the control circuit (A, B, C, D) to the second part (D) of the control circuit (A, B, C, D), and a fifth feedback (18, 19) connecting the second part (D) of the control circuit (A, B, C, D) to the first compensating circuit (E).

* * * * *